US010408048B2

(12) United States Patent
Roberson et al.

(10) Patent No.: US 10,408,048 B2
(45) Date of Patent: Sep. 10, 2019

(54) REMOTE ACTUATION OF DOWNHOLE SENSORS

(71) Applicant: Halliburton Energy Services, Inc., Houston, TX (US)

(72) Inventors: Mark Roberson, Cary, NC (US); Paul Rodney, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/061,266

(22) PCT Filed: Feb. 22, 2016

(86) PCT No.: PCT/US2016/018945
§ 371 (c)(1),
(2) Date: Jun. 11, 2018

(87) PCT Pub. No.: WO2017/146675
PCT Pub. Date: Aug. 31, 2017

(65) Prior Publication Data
US 2018/0363456 A1 Dec. 20, 2018

(51) Int. Cl.
*E21B 47/12* (2012.01)
*E21B 33/14* (2006.01)
*E21B 47/14* (2006.01)

(52) U.S. Cl.
CPC ..... *E21B 47/122* (2013.01); *E21B 33/14* (2013.01); *E21B 47/14* (2013.01)

(58) Field of Classification Search
CPC ..... E21B 47/12; E21B 47/122; E21B 47/16; E21B 47/14; E21B 47/18; E21B 47/00; E21B 47/187; E21B 47/011; E21B 47/06; E21B 47/185; E21B 47/0005; E21B 47/065
See application file for complete search history.

(56) References Cited

U.S. PATENT DOCUMENTS

| | | | |
|---|---|---|---|
| 8,575,936 | B2 | 11/2013 | Bloys et al. |
| 2002/0179301 | A1 | 12/2002 | Schultz et al. |
| 2011/0192592 | A1 | 8/2011 | Roddy et al. |
| 2012/0017673 | A1 | 1/2012 | Godager |
| 2015/0075770 | A1 | 3/2015 | Fripp et al. |

OTHER PUBLICATIONS

International Search Report and Written Opinion issued in related PCT Application No. PCT/US2016/018945 dated Nov. 17, 2016, 16 pages.
International Preliminary Report on Patentability issued in related PCT Application No. PCT/US2016/018945 dated Sep. 7, 2018, 12 pages.

*Primary Examiner* — Zakiya W Bates
(74) *Attorney, Agent, or Firm* — Thomas Rooney; Baker Botts L.L.P.

(57) ABSTRACT

In one or more embodiments, a method includes positioning an actuator in a wellbore and transmitting, from the actuator, an actuation signal to a sensor coupled to a casing in the wellbore. The method further includes detecting the actuation signal at the sensor and placing the sensor in a different mode of operation in response to detecting the actuation signal.

22 Claims, 6 Drawing Sheets

REMOTE ACTUATION OF DOWNHOLE SENSORS

CROSS-REFERENCE TO RELATED APPLICATION

The present application is a U.S. National Stage Application of International Application No. PCT/US2016/018945 filed Feb. 22, 2016, which is incorporated herein by reference in its entirety for all purposes.

BACKGROUND

This disclosure generally relates to sensor actuation. In particular, this disclosure relates to the actuation of sensors in wellbores using magnetic or acoustic signals.

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation. Some or all of these steps may include taking measurements from one or more sensors located in the wellbore. The sensors may include one or more batteries that power the sensors, and the sensors consume power from the one or more batteries when in operation. The lifetime of the one or more batteries of the sensors may be limited, however.

BRIEF DESCRIPTION OF THE DRAWINGS

These drawings illustrate certain aspects of certain embodiments of the present disclosure. They should not be used to limit or define the disclosure.

While embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure describes a system and method for remotely actuating sensors downhole using magnetic or acoustic signals. For example, in particular embodiments, sensors may be kept in a low power consumption state when not in use (e.g., during placement within the wellbore). At pre-determined time intervals, an actuation signal detector located on the sensor may be activated to detect actuation signals. This may include periodically activating the actuation signal detector of the sensor based on a timer circuit, which produces pulses during which time the magnitude of a magnetic field or acoustic signal is determined. If the magnitude of the actuation signal is determined to be above a certain threshold, then one or more components of the sensor electronics may be placed into a different mode of operation (e.g., placed into an "on" state, such as a sensing state, that consumes larger amounts of power). In some embodiments, the actuation signal may be used to place the sensor into one or multiple modes of operation.

To facilitate a better understanding of the present disclosure, the following examples of certain embodiments are given. In no way should the following examples be read to limit, or define, the scope of the invention. For example, embodiments of the present disclosure may be applicable to horizontal, vertical, deviated, or otherwise nonlinear wellbores in any type of subterranean formation. As another example, embodiments may be applicable to injection wells as well as production wells, including hydrocarbon wells.

Figure 1:
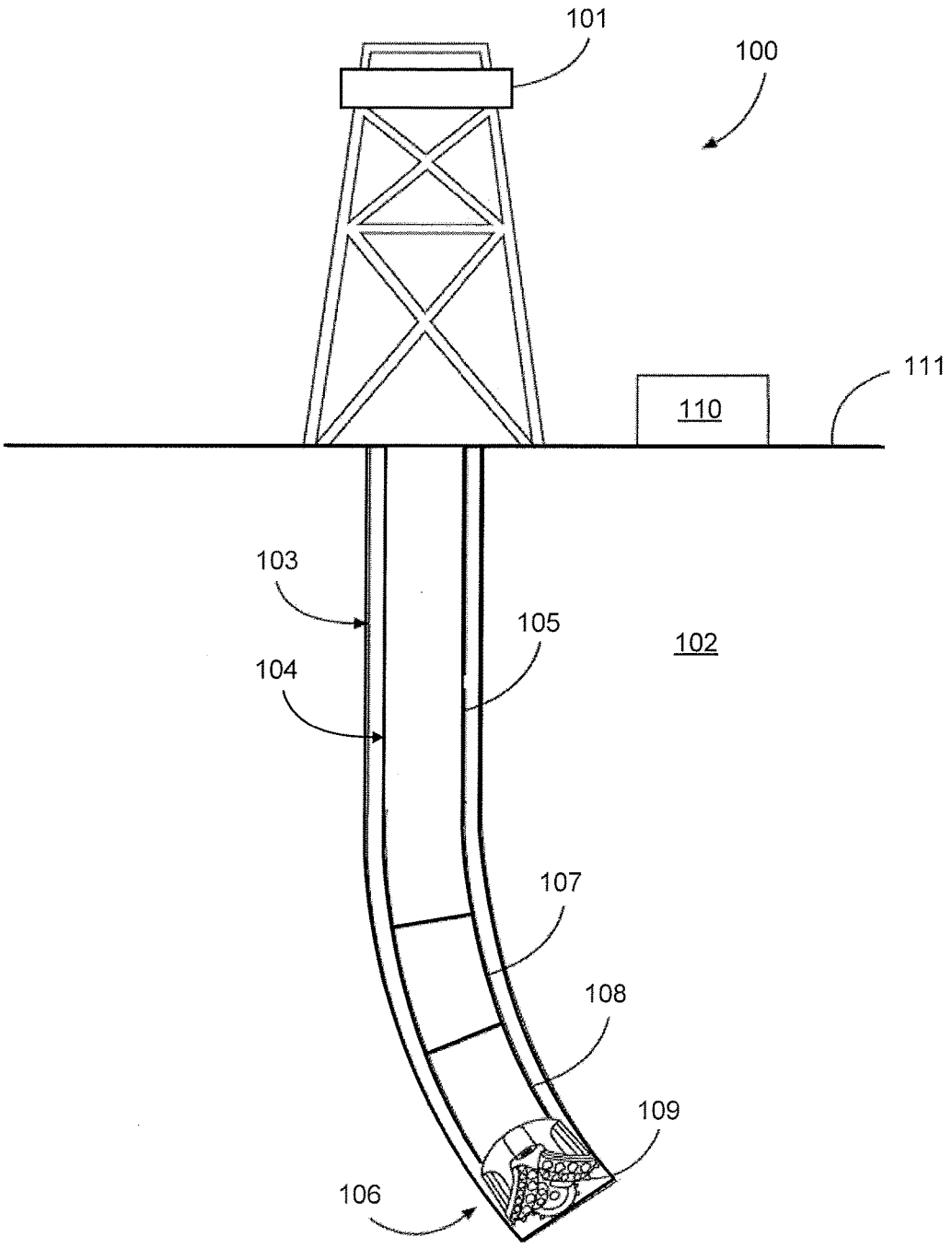
FIG. 1 illustrates an example downhole drilling system in accordance with embodiments of the present disclosure.

FIG. 1 illustrates an example downhole drilling system 100 in accordance with embodiments of the present disclosure. The drilling system 100 includes a rig 101 located at a surface 111 and positioned above a wellbore 103 within a subterranean formation 102. In certain embodiments, a drilling assembly 104 may be coupled to the rig 101 using a drill string 105. In other embodiments, the drilling assembly 104 may be coupled to the rig 101 using a wireline or a slickline, for example. The drilling assembly 104 may include a bottom hole assembly (BHA) 106. The BHA 106 may include a drill bit 109, a steering assembly 108, and a LWD/MWD ("Logging-while-drilling"/"Measurement-while-drilling") apparatus 107 which may include logging tools (e.g., formation logging tools). During drilling operations, drill bit 109 rotates to create wellbore 103, and steering assembly 108 may function to steer drill bit 109 in one or more directions. LWD/MWD apparatus 107 may take one or more measurements during such drilling operations.

Control unit 110 located at the surface 111 may include a processor and memory device, and may communicate with elements of the BHA 106 (e.g., dielectric logging tools in the LWD/MWD apparatus 107). The control unit 110 may receive data from and send control signals downhole, such as to the BHA 106 or components thereof. Additionally, in some embodiments, at least one processor and memory device may be located downhole within the BHA 106 for the same purposes. The LWD/MWD apparatus 107 may log the formation 102 (i.e., sample, test, and/or otherwise obtain information about the formation) both while wellbore 103 is being drilled, and after wellbore 103 is drilled to provide information regarding ongoing subterranean operations.

Modifications, additions, or omissions may be made to FIG. 1 without departing from the scope of the present disclosure. For example, components may be added to downhole drilling system 100 or removed from downhole drilling system 100 as required or desired based upon the drilling operations.

Figure 2B:
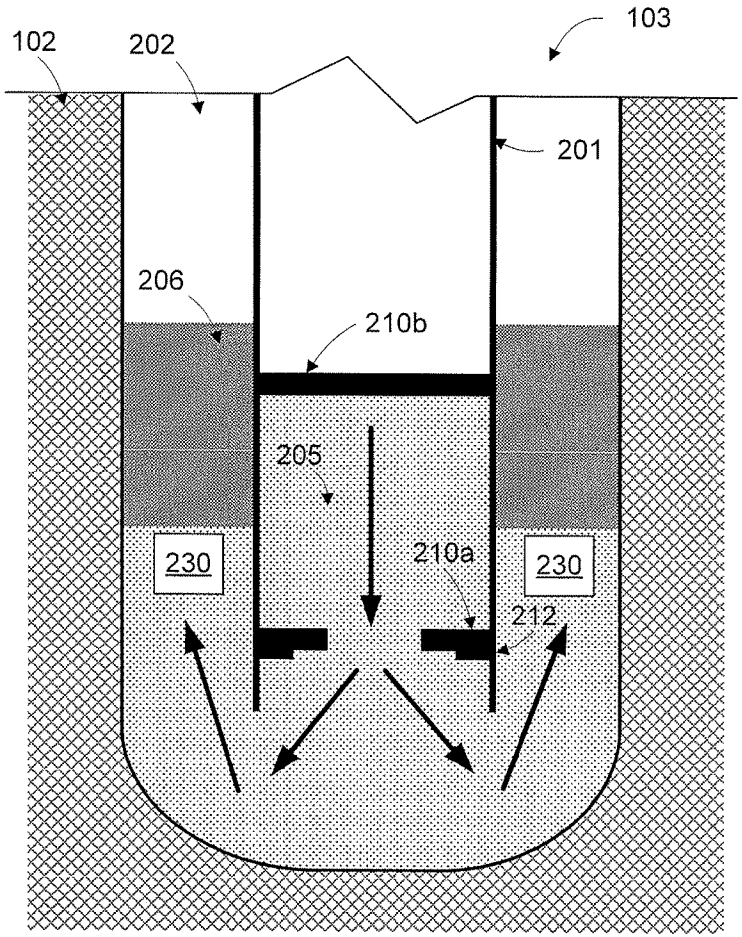
FIGS. 2A-2B illustrate an example wellbore casing and cementing operation in accordance with embodiments of the present disclosure.
Figure 2A:
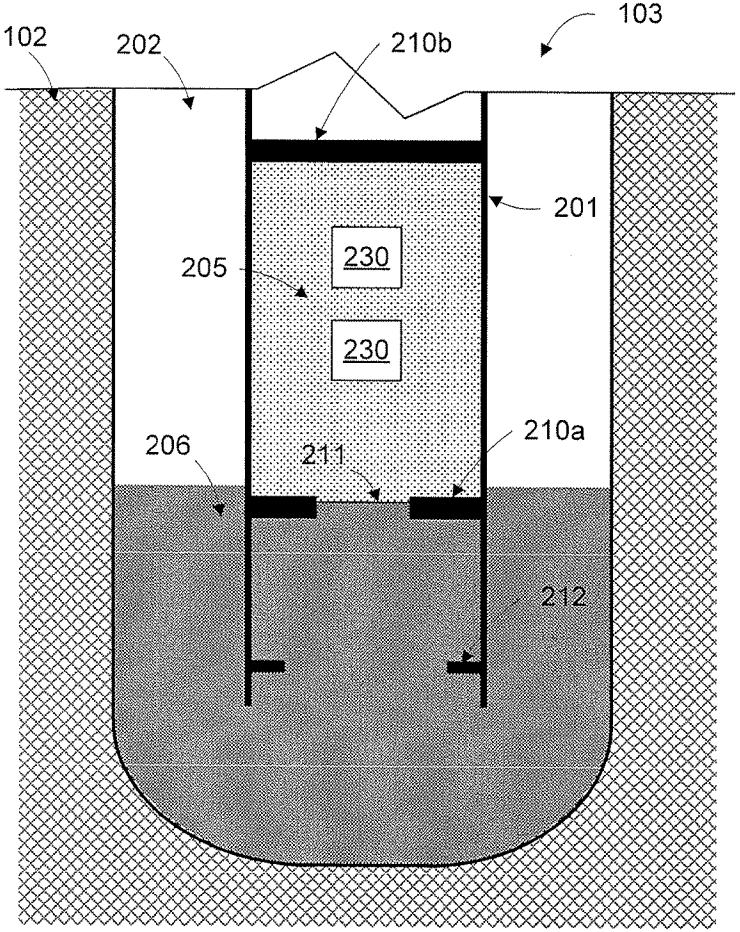

FIGS. 2A-2B illustrate an example wellbore casing and cementing operation in accordance with embodiments of the present disclosure. At some stage in the drilling process, drill string 105 is removed from wellbore 103, and casing 201 is inserted into wellbore 103. Casing 201 may be made of any suitable material, which may include a metal material such as steel in particular embodiments. After casing 201 is run into wellbore 103 at a desired distance, cement 205 may be injected down casing 201 to secure casing 201. This may include introducing bottom plug 210*a* into the interior of casing 201. Bottom plug 210*a* may prevent remaining drilling fluid 206 present in wellbore 103 from mixing with cement 205. For instance, bottom plug 210*a* may comprise diaphragm 211 that prevents cement 205 and drilling fluid 206 from passing therethrough. Cement 205 is then added into wellbore 103 behind bottom plug 210*a*. Top plug 210*b* is then added after cement 205 as shown in FIG. 2A. Pressure is then added to top plug 210*b* to push the column of cement 205 down casing 201. Bottom plug 210*a* is caught just before the end of casing 201 by float collar 212. After this, diaphragm 211 experiences increased pressure from cement 205 until diaphragm 211 is broken within bottom plug 210*a*, permitting cement 205 to flow past bottom plug 210*a* and up the outside of casing 201 and into annulus 202 as shown in FIG. 2B. In certain embodiments, one or more sensors 230 may be placed into cement 205 during the cementing process. Sensors 230 are then pumped down the interior of casing along with cement 205 during the cementing process. Sensors 230 may accordingly be positioned within various portions of annulus 202 at the completion of the cementing process.

Modifications, additions, or omissions may be made to FIGS. 2A-2B without departing from the scope of the present disclosure. For example, fewer components or additional components beyond those illustrated may be included, such as additional casings beyond casing 201 (e.g., additional casings between casing 201 and formation 102). As another example, additional fluids may be used in the cementing process, such as spacer fluids.

Figure 3A:
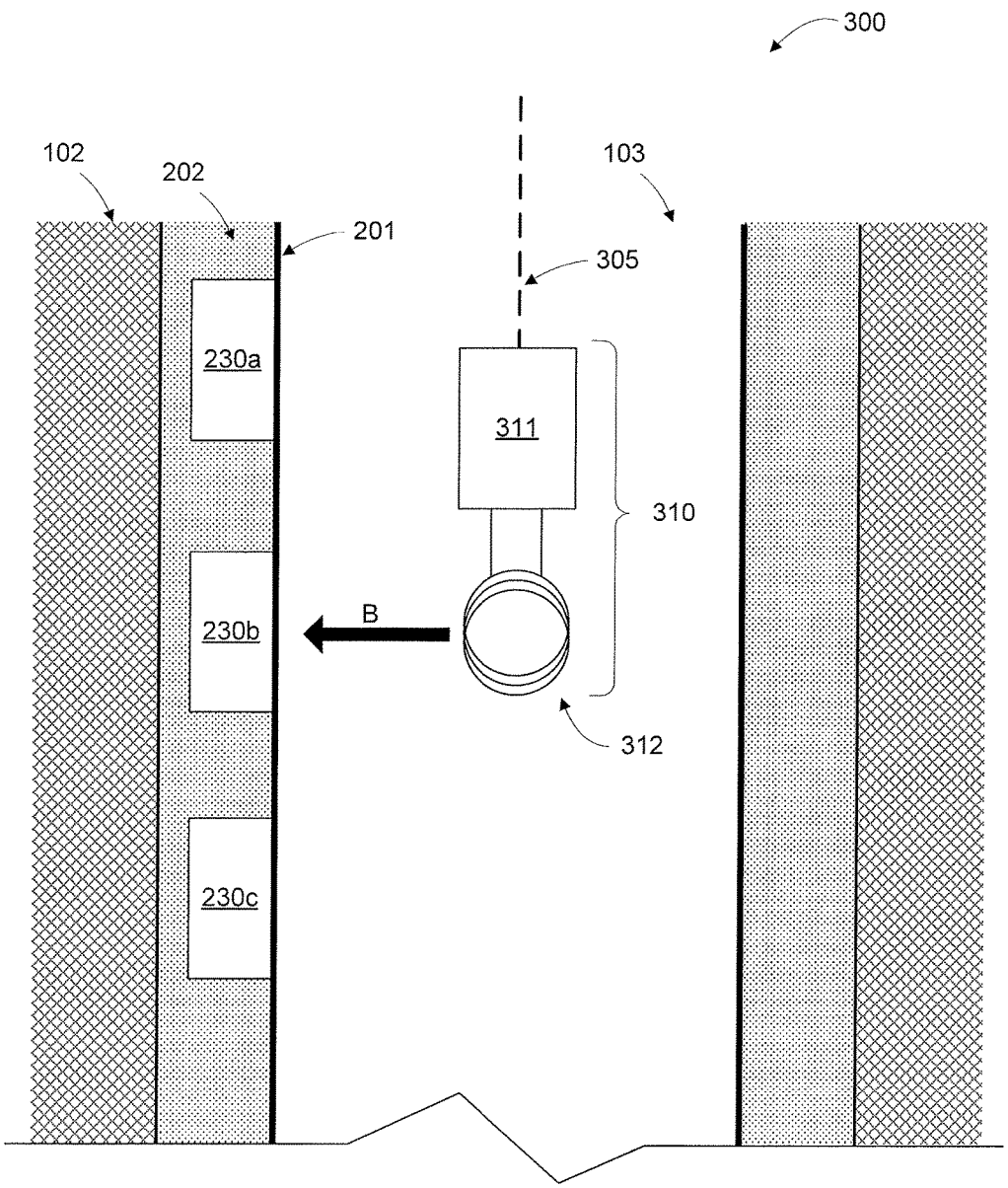
FIGS. 3A-3C illustrate an example remote sensor actuation system in accordance with embodiments of the present disclosure.
Figure 3B:
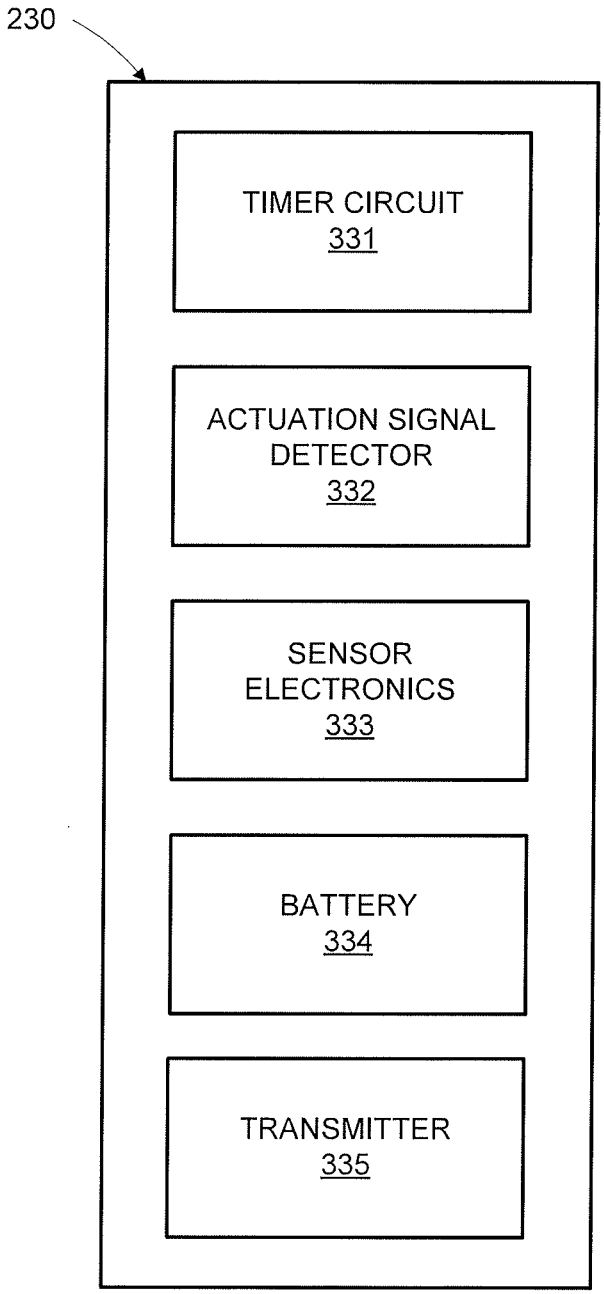
Figure 3C:
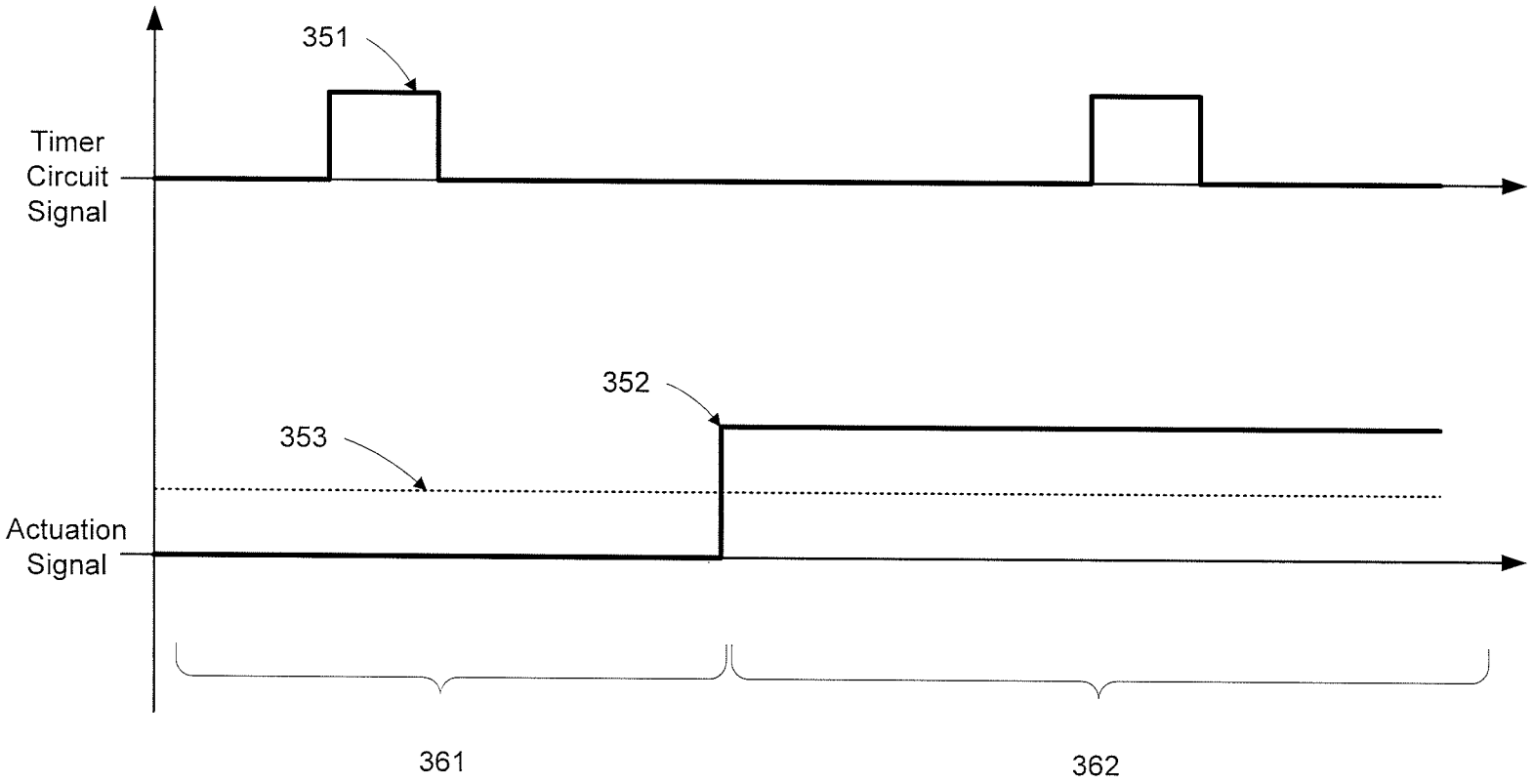

FIGS. 3A-3C illustrate an example remote sensor actuation system 300 in accordance with embodiments of the present disclosure. Referring to FIG. 3A, system 300 includes sensors 230 coupled or proximate to casing 201 of wellbore 103. In some embodiments, sensors 230 may be integrated with or built into casing 201. In other embodiments, sensors 230 may be mechanically or adhesively coupled to casing 201 and then positioned inside wellbore 103 when casing 201 is placed into wellbore 103. In other embodiments, sensors 230 may be positioned within annulus 202 during a wellbore cementing process similar to the one described above (e.g., placed into and pumped along with the cement during the cementing process).

Once sensors 230 are in place within wellbore 103, actuator 310 is lowered down wellbore 103 using cable 305 as illustrated in FIG. 3A. Actuator 310 includes information handling system 311 and magnetic coil 312. Information handling system 311 may include a processor and memory device, and may communicate with coil 312 to generate actuation signals sent by coil 312 to sensors 230. The actuation signals sent by coil 312 may be any suitable magnetic signals, and may be static or dynamic signals (e.g., alternating signals). Cable 305 may be operable to pass signals sent from the surface of wellbore 103 (e.g., from a control unit similar to control unit 110 of FIG. 1) to information handling system 311. Such signals may include the actuation signals for sending to sensors 230 and other signals destined for information handling system 311.

Sensors 230 may include timer circuit 331, actuation signal detector 332, sensor electronics 333, battery 334, and transmitter 335 as illustrated in FIG. 3B. Sensor electronics 333 may include power circuits or any other electronics related to the sensing functions of sensor 230. Sensor electronics 333 may also include an information handling system that controls one or more operations of sensor 230. Transmitter 335 may include any suitable wireless data transmission device, including an ultrasonic transmission device, for sending data collected by the sensor back to the surface of the wellbore. Battery 334 may include any suitable device contained solely within sensor 230 that provides power to one or more components of sensor 230 (e.g., sensor electronics 333 or transmitter 335). Timer circuit 331 may include any suitable electronics for generating a periodic waveform, such as a pulsed waveform similar to waveform 351 of FIG. 3C. Actuation signal detector 332 may be any suitable device for detecting signals sent by a remote actuator in accordance with the present disclosure, and may include a magnetic and/or acoustic signal detector (e.g., a coil or microphone).

In accordance with the present disclosure, components of sensor 230 (e.g., sensor electronics 333) may be kept in a low power consumption state when not in use (e.g., during placement within wellbore 103) to avoid unnecessary drain on battery 334. In certain embodiments, the low power consumption state may be a mode of operation of sensor 230 that does not allow functions of sensor 230 (e.g., measurements and storage thereof) to be performed. At pre-determined time intervals, timer circuit 331 may produce pulses that may activate the actuation signal detector 332 of sensor 230. For example, during the pulses generated by timer circuit 331, the magnitude of a magnetic field or acoustic signal proximate to sensor 230 is determined by actuation signal detector 332. If the magnitude of the magnetic field or acoustic signal is determined to be above a certain threshold, then one or more components of sensors 230 (e.g., sensor electronics 333) may be placed into a different state or mode of operation that consumes larger amounts of power (e.g., a sensing mode of operation wherein power is needed to take and record measurements).

For example, as illustrated in FIG. 3C, timing circuit 331 may produce periodic pulses similar to waveform 351. When the pulses occur, sensor 230 may activate actuation signal detector 332, which determines whether an actuation signal is present. In certain embodiments, the pulse of timing circuit 331 may enable or power the actuation signal detector 332. The presence of the actuation signal may be determined by determining whether the actuation signal waveform 352 is above threshold 353. For instance, when the first pulse of waveform 351 occurs during timeframe 361, actuation signal 352 is below threshold 353 so sensor 230 stays in its current mode of operation (e.g., a low power mode of operation). However, when the second pulse of waveform 351 occurs during timeframe 362, actuation signal 352 is above threshold 353 so sensor 230 is placed into another mode of operation, such as a sensing mode of operation (e.g., taking and recording one or more measurements) or a data transmission mode of operation (e.g., transmitting data from sensor 230 back uphole).

In magnetic embodiments, the magnitude of the magnetic actuation signal B may be any suitable magnitude for use in downhole applications. For example, if the casing is composed of stainless steel, then the magnetic actuation signal may be approximately 0.5 Gauss. Depending on the material of the casing, however, the casing may need to be magnetically saturated before transmitting a magnetic actuation signal. For example, if the casing is composed of iron, then the casing may be magnetically saturated before sending a magnetic actuation signal that greater than 0.5 Gauss.

Although described above as simply activating sensor 230, the actuation signal may be such that it enables one of multiple modes of operation. For example, the sensor 230 may be placed into a full sensing mode of operation wherein all sensing functions of the sensor 230 are enabled. As another example, the sensor 230 may be placed into an intermediate mode of operation wherein only certain sensing functionalities are enabled on sensor 230. The intermediate mode of operation may utilize more power than the low power consumption state sensor 230 is placed in during placement within wellbore 103, but less than a full-power sensing mode of operation. As another example, sensor 230 may be placed into a mode of operation that solely allows transmission of sensor data to the surface using transmitter 335.

Modifications, additions, or omissions may be made to FIGS. 3A-3C without departing from the scope of the present disclosure. For example, although illustrated as actuating sensors 230 using magnetic signals sent by coil 320, acoustic signals sent by an acoustic signal generator may be used to actuate sensors 230. As another example, although illustrated as being in annulus 202 of wellbore 103, sensors 230 may be in any suitable location proximate to casing 201 (e.g., inside casing 201 or on the interior of casing 201 (i.e., integrated with casing 201)). As yet another example, sensors 230 may comprise fewer or additional components than those illustrated and described with respect to FIG. 3B. As yet another example, the waveforms for the timer circuit signal and actuation signals may be different from waveforms 351 and 352 illustrated in FIG. 3C.

Figure 4:
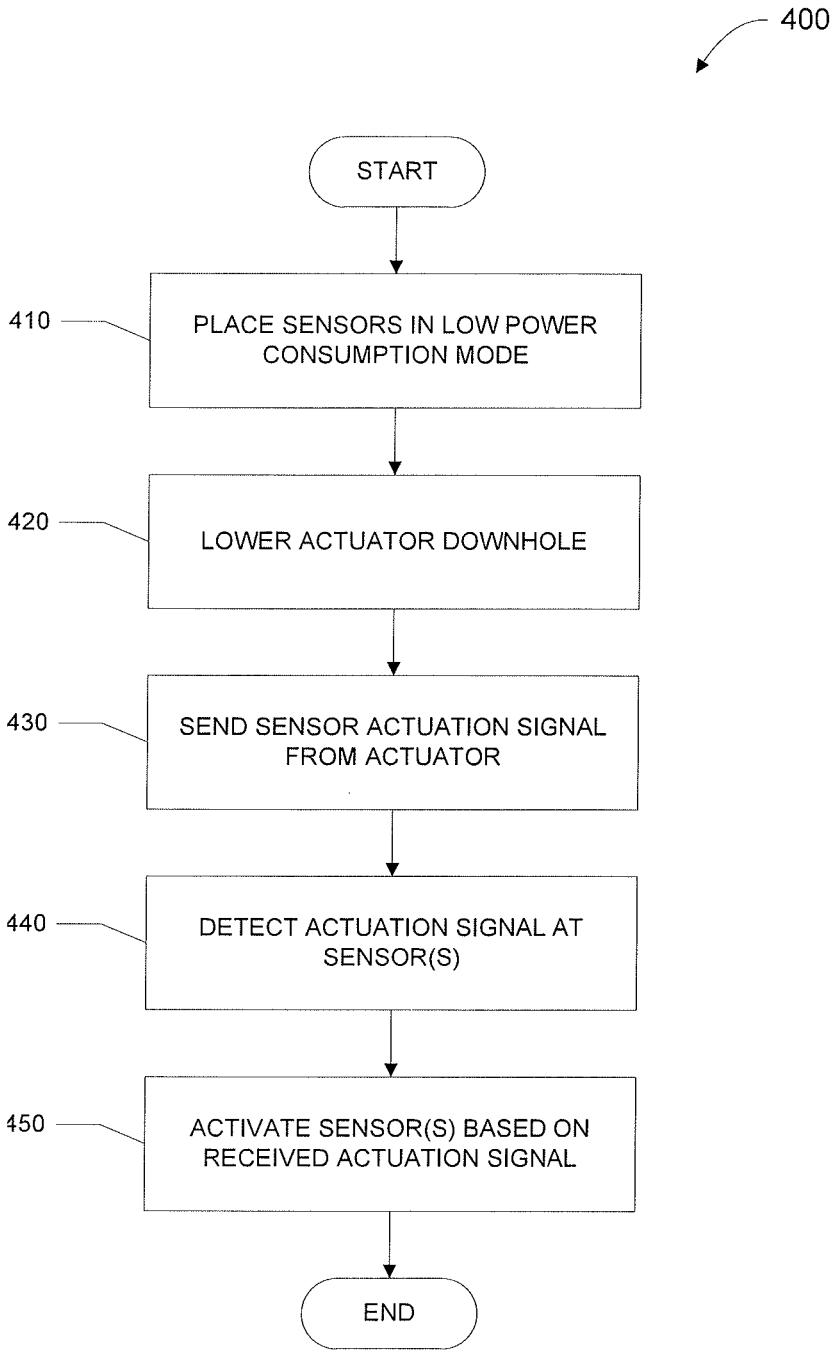
FIG. 4 illustrates an example method for remote actuation of downhole sensors in accordance with embodiments of the present disclosure.

FIG. 4 illustrates an example method 400 for remote actuation of downhole sensors in accordance with embodiments of the present disclosure. The method begins at step 410, where downhole sensors are placed into a low power mode of operation. This may be done during the process of placing the sensors downhole, such as during a wellbore casing and cementing process. The sensors may be coupled to the casing of the wellbore in certain embodiments, and may be integrated with the casing in certain embodiments. In other embodiments, the sensors may be disposed in cement in an annulus of the wellbore.

At step 420, an actuator is lowered downhole. This step may occur at any suitable time after the sensors have been placed downhole. For instance, the actuator may not be lowered downhole for many days or weeks after the sensors have been placed downhole. Accordingly, by keeping the sensors in the low power mode of operation during this time, battery life of the sensors is preserved. The actuator may be placed proximate to one or more of the sensors located downhole in order to activate or otherwise actuate them.

Then, at step 430, the actuator sends an actuation signal to the sensors. The actuation signal may be any suitable signal for sending to the downhole sensors, and may be a magnetic signal or an acoustic signal in certain embodiments. The strength of the magnetic signal may depend on the material of the casing. For example, if the casing is composed of stainless steel, then the magnetic actuation signal may be approximately 0.5 Gauss. Depending on the material of the casing, however, the casing may need to be magnetically saturated before transmitting a magnetic actuation signal. For example, if the casing is composed of iron, then the casing may be magnetically saturated before sending a magnetic actuation signal that greater than 0.5 Gauss.

At step 440, the actuation signal is detected at the sensors. This may be done using actuation signal detectors located on the sensors. In certain embodiments, to avoid further battery drain, the actuation signal detectors may only be periodically activated such that they do not sense or listen for actuation signals continuously. This may be done, in particular embodiments, based on a timer circuit that generates periodic pulses. The periodic pulses may be used to power or otherwise activate the actuation signal detector.

Finally, at step 450, the sensors are activated by the detected actuation signal. This may include comparing the detected actuation signal to a certain threshold, as described above with respect to FIG. 3C. In other embodiments, this step may include comparing the actuation signal to known waveforms to determine a particular instruction for the sensor (e.g., to place the sensor into one of multiple possibly modes of operation). For instance, an actuation signal having a first type of waveform may be used to place the sensor into a sensing mode of operation wherein the sensor takes and records one or more measurements, and an actuation signal having a second type of waveform may be used to place the sensor into a transmitting mode of operation wherein the sensor transmits its data to the surface of the wellbore.

Modifications, additions, or omissions may be made to method 400 of FIG. 4 without departing from the scope of the present disclosure. For example, steps of method 400 may be performed in a different order than indicated or may be performed simultaneously with one or more other steps in method 400. In addition, method 400 may comprise fewer or additional steps than those illustrated in FIG. 4 and described above.

To provide illustrations of one or more embodiments of the present disclosure, the following examples are provided.

In one or more embodiments, a method includes positioning an actuator in a wellbore and transmitting, from the actuator, an actuation signal to a sensor coupled to a casing in the wellbore and operating in a first mode of operation. The method further includes detecting the actuation signal at the sensor using an actuation signal detector and placing the sensor into a second mode of operation in response to detecting the actuation signal.

In one or more of the embodiments described in the preceding paragraph, detecting the actuation signal at the sensor comprises periodically activating the actuation signal detector of the sensor based on signals from a timer circuit.

In one or more of the embodiments described in the preceding two paragraphs, the signals from the timer circuit comprise pulses, and the actuation signal detector is activated during the pulses.

In one or more of the embodiments described in the preceding three paragraphs, the first mode of operation consumes less power than the second mode of operation.

In one or more of the embodiments described in the preceding four paragraphs, placing the sensors into the second mode of operation comprises enabling sensing capabilities of the sensor.

In one or more of the embodiments described in the preceding five paragraphs, the actuation signal comprises a magnetic signal.

In one or more of the embodiments described in the preceding six paragraphs, the actuation signal comprises an acoustic signal.

In one or more of the embodiments described in the preceding seven paragraphs, positioning the actuator in the wellbore comprises lowering the actuator downhole within the wellbore casing.

In one or more embodiments, a system includes a casing disposed within a wellbore in a formation, an actuator disposed in the wellbore and operable to generate actuation signals, and one or more sensors coupled to the casing. Each of the one or more sensors comprises an actuation signal detector operable to detect actuation signals generated by the actuator, and logic configured, when executed, to modify a mode of operation for the sensor based on a detected actuation signal.

In one or more of the embodiments described in the preceding paragraph, each of the one or more sensors comprises a timer circuit operable to generate periodic pulses, and the actuation signal detector is operable to detect the actuation signals generated by the actuator when the periodic pulses are generated by the timer circuit.

In one or more of the embodiments described in the preceding two paragraphs, the logic configured to modify a mode of operation for the sensor based on the detected actuation signal is further configured to place the sensor into a mode of operation that consumes more power than a current mode of operation.

In one or more of the embodiments described in the preceding three paragraphs, the logic configured to modify a mode of operation for the sensor based on the detected actuation signal is further configured to place the sensor into a sensing mode of operation.

In one or more of the embodiments described in the preceding four paragraphs, the actuator comprises a coil operable to generate magnetic signals.

In one or more of the embodiments described in the preceding five paragraphs, the actuator comprises an acoustic tool operable to generate acoustic signals.

In one or more embodiments, a method includes positioning an actuator in a wellbore and transmitting, from the actuator, an actuation signal to a sensor disposed in an annulus of the wellbore and operating in a first mode of operation. The method further includes detecting the actuation signal at the sensor using an actuation signal detector and placing the sensor into a second mode of operation in response to detecting the actuation signal.

In one or more of the embodiments described in the preceding paragraph, detecting the actuation signal at the sensor comprises periodically activating the actuation signal detector of the sensor based on signals from a timer circuit.

In one or more of the embodiments described in the preceding two paragraphs, the signals from the timer circuit comprise pulses, and the actuation signal detector is activated during the pulses.

In one or more of the embodiments described in the preceding three paragraphs, the first mode of operation consumes less power than the second mode of operation.

In one or more of the embodiments described in the preceding four paragraphs, placing the sensors into the second mode of operation comprises enabling sensing capabilities of the sensor.

In one or more of the embodiments described in the preceding five paragraphs, the method further includes positioning a casing within the wellbore, positioning the sensor in cement within the casing, and injecting the cement into the interior of the casing such that the sensor becomes disposed in the annulus of the wellbore.

In one or more of the embodiments described in the preceding six paragraphs, positioning the sensor in the cement within the casing comprises positioning a bottom plug within the casing, adding cement to the interior of the casing behind the bottom plug, positioning the sensor in the cement, and positioning a top plug within the casing.

In one or more of the embodiments described in the preceding seven paragraphs, the bottom plug comprises a diaphragm, and injecting the cement into the interior of the casing comprises adding pressure to the top plug until the diaphragm is broken to allow the cement to flow within the annulus of the wellbore.

Therefore, the present disclosure is well-adapted to carry out the objects and attain the ends and advantages mentioned as well as those which are inherent therein. While the disclosure has been depicted and described by reference to exemplary embodiments of the disclosure, such a reference does not imply a limitation on the disclosure, and no such limitation is to be inferred. The disclosure is capable of considerable modification, alteration, and equivalents in form and function, as will occur to those ordinarily skilled in the pertinent arts and having the benefit of this disclosure. The depicted and described embodiments of the disclosure are exemplary only, and are not exhaustive of the scope of the disclosure. Consequently, the disclosure is intended to be limited only by the spirit and scope of the appended claims, giving full cognizance to equivalents in all respects. The terms in the claims have their plain, ordinary meaning unless otherwise explicitly and clearly defined by the patentee.

The terms "couple" or "couples" as used herein are intended to mean either an indirect or a direct connection. Thus, if a first device couples to a second device, that connection may be through a direct connection, or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections. Finally, the term "uphole" as used herein means along the drill string or the hole from the distal end towards the surface, and "downhole" as used herein means along the drill string or the hole from the surface towards the distal end.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such as wires, optical fibers, microwaves, radio waves, and other electromagnetic and/or optical carriers; and/or any combination of the foregoing.

What is claimed is:

1. A method, comprising:

positioning an actuator in a wellbore;

transmitting, from the actuator, an actuation signal to a sensor coupled to a casing in the wellbore, the sensor operating in a first mode of operation, wherein the sensor comprises at least three modes of operation, and wherein the first mode of operation comprises a low power mode that does not allow one or more functions of the sensor;

detecting the actuation signal at the sensor using an actuation signal detector, wherein the sensor includes the actuation signal detector; and placing the sensor into a second mode of operation in response to detecting the actuation signal, wherein the second mode of operation comprises at least one of a sensing mode and a data transmission mode, and wherein the second mode of operation consumes more power than the low power mode.

2. The method of claim 1, wherein detecting the actuation signal at the sensor comprises periodically activating the actuation signal detector of the sensor based on signals from a timer circuit.

3. The method of claim 2, wherein the signals from the timer circuit comprise pulses, and the actuation signal detector is activated during the pulses.

4. The method of claim 1, wherein the first mode of operation consumes less power than the second mode of operation.

5. The method of claim 1, wherein placing the sensors into the second mode of operation comprises enabling sensing capabilities of the sensor.

6. The method of claim 1, wherein the actuation signal comprises a magnetic signal.

7. The method of claim 1, wherein the actuation signal comprises an acoustic signal.

8. The method of claim 1, wherein positioning the actuator in the wellbore comprises lowering the actuator downhole within the wellbore casing.

9. A system, comprising:

a casing disposed within a wellbore in a formation;

an actuator disposed in the wellbore, the actuator operable to generate actuation signals; and one or more sensors coupled to the casing, wherein the one or more sensors comprise at least three modes of operation, wherein the first mode of operation comprises a low power mode that does not allow one or more functions of the one or more sensors, and wherein each of the one or more sensors comprises:

an actuation signal detector operable to detect actuation signals generated by the actuator; and logic configured, when executed, to place the one or more sensors in a second mode of operation for the sensor based on a detected actuation signal, wherein the second mode of operation comprises at least one of a sensing mode and a data transmission mode, and wherein the second mode of operation consumes more power than the low power mode.

10. The system of claim 9, wherein:

each of the one or more sensors comprises a timer circuit operable to generate periodic pulses; and the actuation signal detector is operable to detect the actuation signals generated by the actuator when the periodic pulses are generated by the timer circuit.

11. The system of claim 9, wherein the logic configured to modify a mode of operation for the sensor based on the detected actuation signal is further configured to place the sensor into a mode of operation that consumes more power than a current mode of operation.

12. The system of claim 9, wherein the logic configured to modify a mode of operation for the sensor based on the detected actuation signal is further configured to place the sensor into a sensing mode of operation.

13. The system of claim 9, wherein the actuator comprises a coil operable to generate magnetic signals.

14. The system of claim 9, wherein the actuator comprises an acoustic tool operable to generate acoustic signals.

15. A method, comprising:

positioning an actuator in a wellbore;

transmitting, from the actuator, an actuation signal to a sensor disposed in an annulus of the wellbore, the sensor operating in a first mode of operation, wherein the sensor comprises at least three modes of operation, wherein the first mode of operation comprises a low power mode that does not allow one or more functions of the sensor;

detecting the actuation signal at the sensor using an actuation signal detector, wherein the sensor includes the actuation signal detector; and placing the sensor into a second mode of operation in response to detecting the actuation signal, wherein the second mode of operation comprises at least one of a sensing mode and a data transmission mode, and wherein the second mode of operation consumes more power than the low power mode.

16. The method of claim 15, wherein detecting the actuation signal at the sensor comprises periodically activating the actuation signal detector of the sensor based on signals from a timer circuit.

17. The method of claim 16, wherein the signals from the timer circuit comprise pulses, and the actuation signal detector is activated during the pulses.

18. The method of claim 15, wherein the first mode of operation consumes less power than the second mode of operation.

19. The method of claim 15, wherein placing the sensors into the second mode of operation comprises enabling sensing capabilities of the sensor.

20. The method of claim 15, further comprising:

positioning a casing within the wellbore;

positioning the sensor in cement within the casing; and injecting the cement into the interior of the casing such that the sensor becomes disposed in the annulus of the wellbore.

21. The method of claim 20, wherein positioning the sensor in the cement within the casing comprises:

positioning a bottom plug within the casing;

adding cement to the interior of the casing behind the bottom plug;

positioning the sensor in the cement; and positioning a top plug within the casing.

22. The method of claim 21, wherein the bottom plug comprises a diaphragm, and injecting the cement into the interior of the casing comprises adding pressure to the top plug until the diaphragm is broken to allow the cement to flow within the annulus of the wellbore.

* * * * *